United States Patent [19]

DeLuca

[11] 4,307,639

[45] Dec. 29, 1981

[54] MULTIPLE WOUND ROLL DISPENSER FOR FLEXIBLE SHEET MATERIAL

[75] Inventor: Raymond F. DeLuca, Stamford, Conn.

[73] Assignee: Georgia-Pacific Corporation, Portland, Oreg.

[21] Appl. No.: 58,867

[22] Filed: Jul. 19, 1979

Related U.S. Application Data

[63] Continuation of Ser. No. 897,431, Apr. 18, 1978, abandoned.

[51] Int. Cl.[3] ..... A47K 10/36; A47K 10/38

[52] U.S. Cl. ..... 83/337; 226/91; 242/55.3; 242/58; 312/39

[58] Field of Search ..... 242/55.3, 55.53, 68.4, 242/68.5, 72 R; 83/337, 345; 312/39; 226/91

[56] References Cited

U.S. PATENT DOCUMENTS

| | | | |
|---|---|---|---|
| 849,091 | 4/1907 | Votey | 242/68.4 |
| 1,817,479 | 8/1931 | Crowson | 242/55.53 X |
| 2,738,934 | 3/1956 | Dobkin | 242/55.3 |
| 3,018,977 | 1/1962 | Skallquist | 242/68.4 X |
| 3,288,387 | 11/1966 | Craven | 242/55.53 |
| 3,374,042 | 3/1968 | Smith | 242/55.3 |
| 3,792,822 | 2/1974 | Underhill | 242/55.3 |
| 4,176,569 | 12/1979 | DeLuca | 242/55.3 |

*Primary Examiner*—Edward J. McCarthy
*Attorney, Agent, or Firm*—Schuyler, Banner, Birch, McKie & Beckett

[57] ABSTRACT

A dispenser for wound rolls of flexible sheet material, such as, paper towels, toilet tissue or the like has inwardly facing tracks on the opposite inner side walls of the dispenser housing to receive therein outwardly projecting spindles carried by wound rolls to be dispensed for the rolls to move in succession downwardly relative to the tracks with a section of the lower end of each track slanting away from a feed roller mounted adjacent the lower end of the dispenser housing and each track having at such lower end section a pivotally mounted roll rotation driving guide biased toward the track center to form the lower side of each track section slanting away from the feed roller. A pressure roller is biased into rotating engagement with the feed roller for flexible sheet material to drivingly pass therebetween with the pressure roller having at least one resiliently deformable segment that is eccentric to the pressure roller axis to pick up the leading free end of sheet material on a full roll and lead it into the nip between the feed roller and pressure roller, this pressure roller also has axially spaced conical resilient portions along the length thereof with the conical portions facing from the opposite ends of the pressure roll inwardly toward the mid-point of the pressure roll to promote spreading out the sheet material passing between the feed roller and the pressure roller. A serrated cutting knife is pivotally mounted within the feed roller to sever the sheet material, the serrations on the knife being spaced to accommodate therebetween the deformable eccentric segment and the conical portions on the pressure roller during initial projection of the knife from within the feed roller in severing the sheet material.

32 Claims, 14 Drawing Figures

MULTIPLE WOUND ROLL DISPENSER FOR FLEXIBLE SHEET MATERIAL

This is a continuation of application Ser. No. 897,431 filed Apr. 18, 1978, now abandoned.

BACKGROUND OF THE INVENTION

This invention relates to dispensers for wound rolls of flexible sheet material and particularly to dispensers for rolls of paper towels, tissue paper, and the like, wherein each roll has supporting spindles projecting outwardly from the ends of the core of the roll. More specifically, the dispensers to which the instant invention relates, are concerned with dispensing a web of flexible sheet material from wound rolls wherein multiple rolls can be retained for dispensing from each roll in succession with precision in unwinding the material from each roll and assurance that the leading free end on the exterior of each wound roll will feed into the dispensing mechanism with reliability so that the user will have accessibility to the sheet material exteriorly of the dispenser housing.

Numerous web dispensing constructions are known in the prior art and employed in commercial use where a paper towel dispenser, for example is mounted on a wall in a location where towel availability is desired. Considering the large number of such dispensers employed in may commercial installations such as factories, office buildings, institutions, etc., more and more attention has been devoted to consideration of the substantial expense in time and labor required in replenishing the exhausted wound rolls in such dispensers, particularly where a single roll is the limit of capability to be housed within each dispenser unit.

Accordingly, many structures have been developed to accommodate multiple rolls of wound sheet material so that the individual dispenser need only be replenished when the entire compliment of rolls within the dispenser has been exhausted, namely, where a first roll has been used up and a reserve roll is available within the dispenser to move into the dispensing position and feed out the sheet material from such reserve roll. Obviously, this reduces the time and expense required in replenishing rolls in the multitude of dispensers in a commercial establishment so that the labor cost is correspondingly reduced.

Whereas the single roll dispenser can be easily loaded with a roll by an attendant and the free leading web end on the roll threaded in and through the dispensing mechanism to be available to a user externally of the dispenser housing, the advent of dispensers accommodating multiple rolls gave rise to particular problems in providing a construction which effectively enables the leading free web end on the exterior of a reserve roll to be picked up by the dispensing mechanism in the dispenser and reliably fed out of the dispenser once an initial roll had been exhausted. The problem is to assure that this pick up and feeding from the reserve roll is effectively and accurately carried out automatically in the absence of an attendant having to return to the dispenser to start the leading free end of the reserve roll out through the feeding mechanism. Of course, this would defeat the purpose of multiple roll dispensers.

The prior art has proposed numerous ideas, constructions and mechanisms to carry out this pick up of the leading free end on a reserve roll. Each hopefully aims at getting automatic and accurate feeding of the end of the new roll into the feeding mechanism so that the multiple roll dispenser can continue operating and supply its web of sheet material to the prospective users of the dispenser. Whereas attempts in development of multiple roll dispensers have sought to achieve the ultimate, there have been numerous defects and failings in the achieving assurance that the web of paper on the reserve roll is properly picked up, properly fed to the dispensing mechanism and properly available to the prospective users exteriorally of the dispenser housing.

These problems call for structures that are simple and yet effective if the dispenser is to be readily understood and adaptable to easy loading by attendants who could become confused with structures involving complicated dispensing mechanisms where threading of even the lead end of the initial wound roll may be overly complicated. With complex dispensers, proper loading and assurance that the lead end on a reserve roll will be picked up may be beyond the comprehension of attendants who are assigned the task of loading numerous multiple roll dispensers in commercial establishments that employ a great number or even small number of multiple roll dispensers.

SUMMARY OF THE INVENTION

The wound roll dispenser of the present invention is particularly adaptable for multiple rolls held within the dispenser housing on supporting spindles projecting outwardly from both roll core ends. Inwardly facing tracks on the opposite inner sidewalls of the dispenser housing receive the outwardly projecting spindles fixedly held in a roll core, either in the form of core end caps or a mandrel, specifically constructed to promote rotation of the rolls as they move downwardly within the tracks. The lowermost roll engages and is driven by a rotatably mounted feed roller disposed adjacent the bottom ends of the tracks.

Additionally, as an important part of the invention, a pressure roller, rotatably mounted in the dispenser housing, is associated in driven relation with the feed roller. This pressure roller is formed with eccentrically disposed axially spaced resilient segments that serve, upon rotation of the pressure roller, to pick up the leading free end of sheet material on the exterior of a full roll and feed it into the nip between the feed roller and pressure roller, thereby assuring that the web material from a roll in the bottom position of the tracks resting on the feed roller is fed between the rollers and thence out of the dispenser for access by a user. The pressure roller also is provided with axially spaced cylindrical resilient conical portions that press against the feed roller as the sheet material passes between the nip of the rollers.

The above referred to inwardly facing tracks, within which the spindles extending from the roll core ends are supported, have a lower end section of each track slanting away from the longitudinal axis of the main length of the track and generally slanting toward a position tangent to the perimeter of the feed roller. This lower end section of each track is provided with a pivotally supported guide that is biased inwardly toward the center line of the track, this guide being disposed on the lower side of the slanting track section. The biased guides promote rotation of the wound roll passing down the tracks by pressing against the periphery of the spindles at opposite ends of the roll. This action rotates the roll during its downward movement within the tracks. The lower end section of each track need not necessarily be slanted as above mentioned but should have the inwardly biased guide disposed on the side of the track disposed in the direction that the sheet material will be drawn off of the roll when it is engaging the feed roller and pressure roller while being drawn out of the dispenser.

As for the above-mentioned pressure roller, the resiliently deformable segments on the pressure roller project eccentrically outwardly throughout a part of the periphery of the pressure roller and are positioned so that a full roll at the bottom of the dispenser tracks will not only engage the feed roller but also engage the pressure roller. As the pressure roller rotates with the feed roller the deformable eccentric segments will move against the leading free end of sheet material on the roll causing it to buckle downwardly into the nip between the two rollers. Also, the axially spaced resilient cylindrical portions on the feed roller promote driving of the two rollers by each other as the sheet material is drawn between the nip. These resilient portions preferably are conical in configuration with each conical portion facing inwardly toward the mid-point of the pressure roller so as to promote spreading out of the sheet material along the width of the nip between the rollers.

The dispenser of the invention embodying the above described features also preferably is provided with a mechanism for stopping rotation of the feed roller and pressure roller and thus arresting movement of the sheet material so that an individual sheet of material which has been severed from the web of material unwound from the roll has its free end immediately accessible to a user. Also, a cam actuated knife pivotally mounted within the feed roller is projected through an elongated opening in the feed roller wall as the feed roller is rotated with the sheet material overlying its surface. The cam action is constructed to positively project and retract the knife relative to the opening in the feed roller and the activating cams are stationarily mounted such that the knife, which has serations therealong, initially projects outwardly immediately before the web of material reaches the nip of the feed roller and pressure roller. There serations are spaced to enter between the eccentric segments and conical resilient portions carried by the pressure roller to start perforation of the web adjacent the nip of the rollers.

With the foregoing in mind, it is a principal object of the present invention to provide a flexible sheet material dispenser having improved mounting for wound rolls carried within the dispenser to assure rotation of the rolls in promoting the dispensing action.

An important object of the invention is to provide for inter-engaging feed and pressure rollers with the pressure roller especially configured to promote pick up of a leading end of sheet material on the exterior of a full wound roll.

A further important object of the invention is to provide a pressure roll in accordance with the above object wherein resilient means are carried spaced along the length, of the roll to promote, incident rotation of the pressure roller, spreading out of the sheet material across the width of the nip between a feed roller and pressure roller.

Another object of the invention is to provide a dispenser having opposite inwardly facing tracks to receive the spindles of rolls to be dispensed from the dispenser where a lower end section of each track carries a guide means which is biased inwardly toward the center of the track to offer a friction surface along which the periphery of a roll spindle within the track will engage to promote roll rotation.

It is also an object of the instant invention, in accordance with the above object, to employ a slanting lower end section of each track which slants away from the axis of a feed roller with the biased guide means of each track being located on the lower side of each slanting track section.

An additional object of the invention is to provide a dispenser in accordance with the above objects wherein one roll spindle has a peripheral groove spaced inwardly from the outer most end of the spindle and one track has flange means through which the groove passes when the spindle is lowered into the dispenser tracks such that proper loading direction-wise for the roll within the dispenser is assured.

These and other objects of the invention will become apparent upon consideration of the detailed description of a preferred embodiment of the invention given in connection with the following described drawings which form a part of this invention.

DESCRIPTION OF A PREFERRED EMBODIMENT OF THE INVENTION

Figure 1:
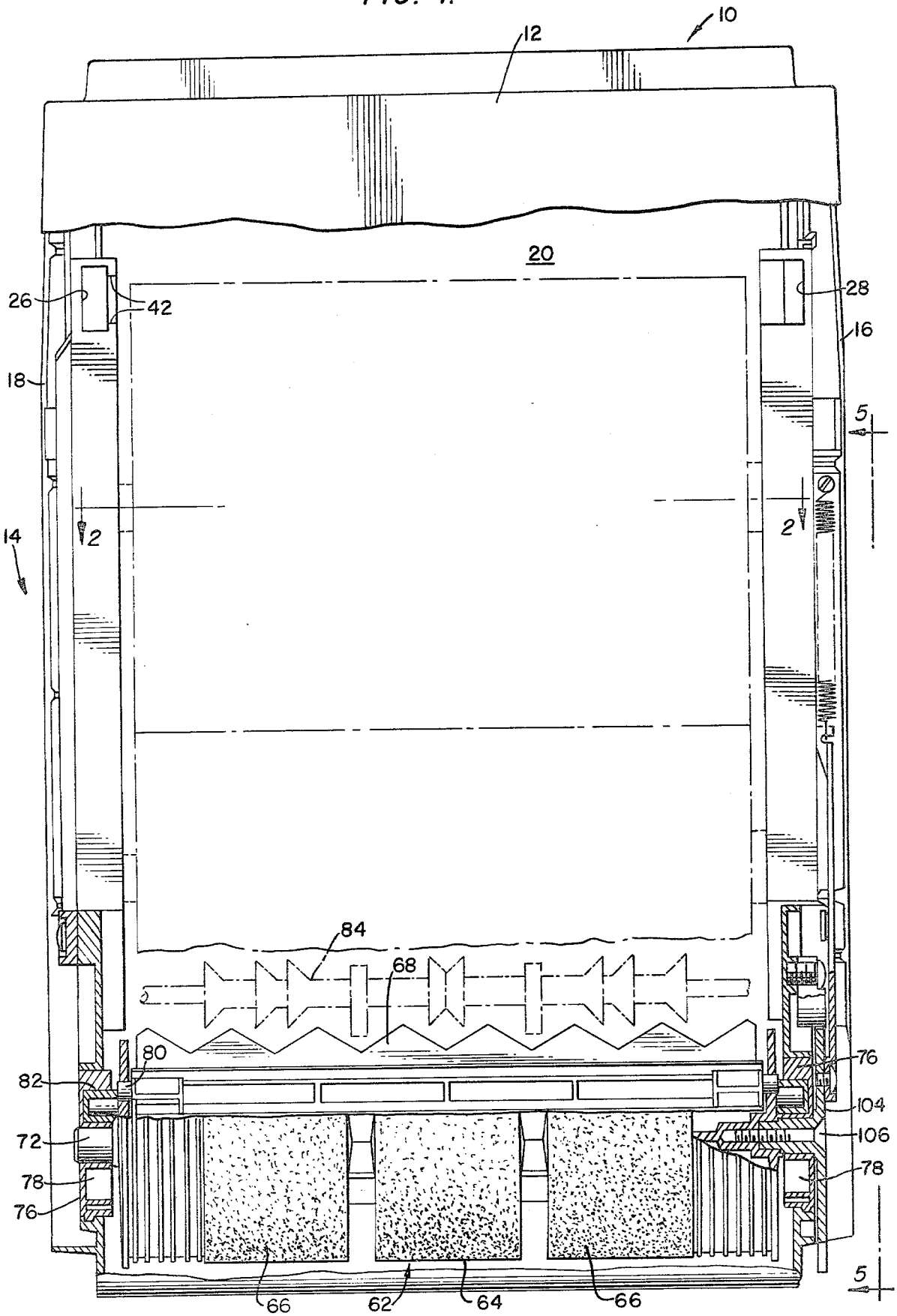
FIG. 1 is a front elevational view of the wound roll dispenser for flexible sheet material of this invention with the front cover broken away expose components within the interior of the dispenser housing.
Figure 7:
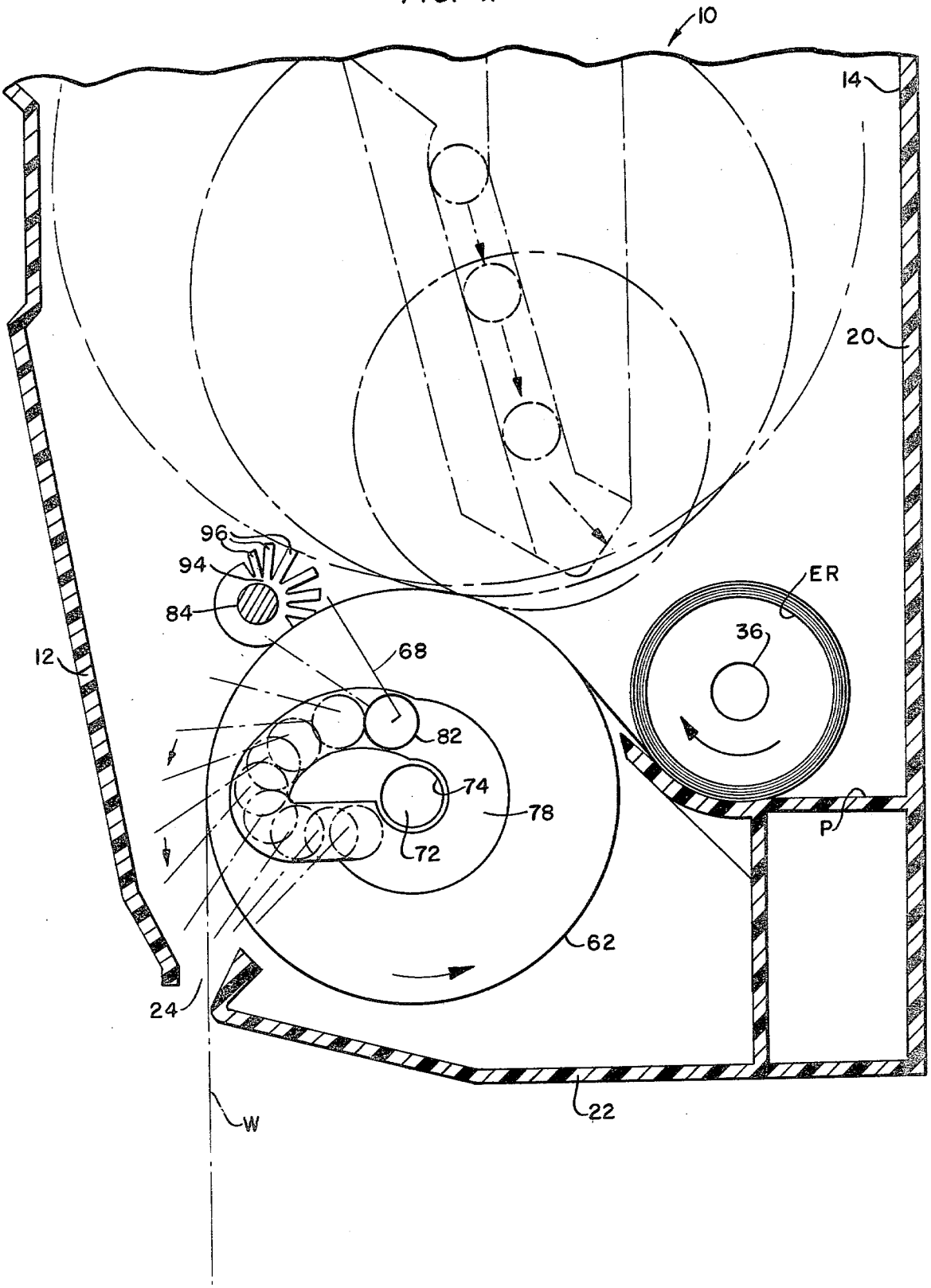
FIG. 7 is a sectional view through the front cover, back and bottom of the dispenser housing showing positions of wound rolls relative to a feed roller, cam activated cutting knife and pressure roller disposed within the housing.

The complete wound roll dispenser is shown in FIG. 1 as a multiple roll dispenser provided with a housing 10 made up of a cover 12, the lower portion being removed to expose the inner workings of the dispenser, a chassis 14 which provides inner sidewalls 16 and 18 and a backwall 20. A bottom wall 22 is also provided by chassis 14 as part of the dispenser housing 10, as best seen in FIG. 7. An elongated opening 24 across a major portion of the width of the dispenser housing is provided at the forward end of the bottom wall 22 of chassis 14 to provide means for leading the dispensed sheet material to access to a user.

Figure 2:
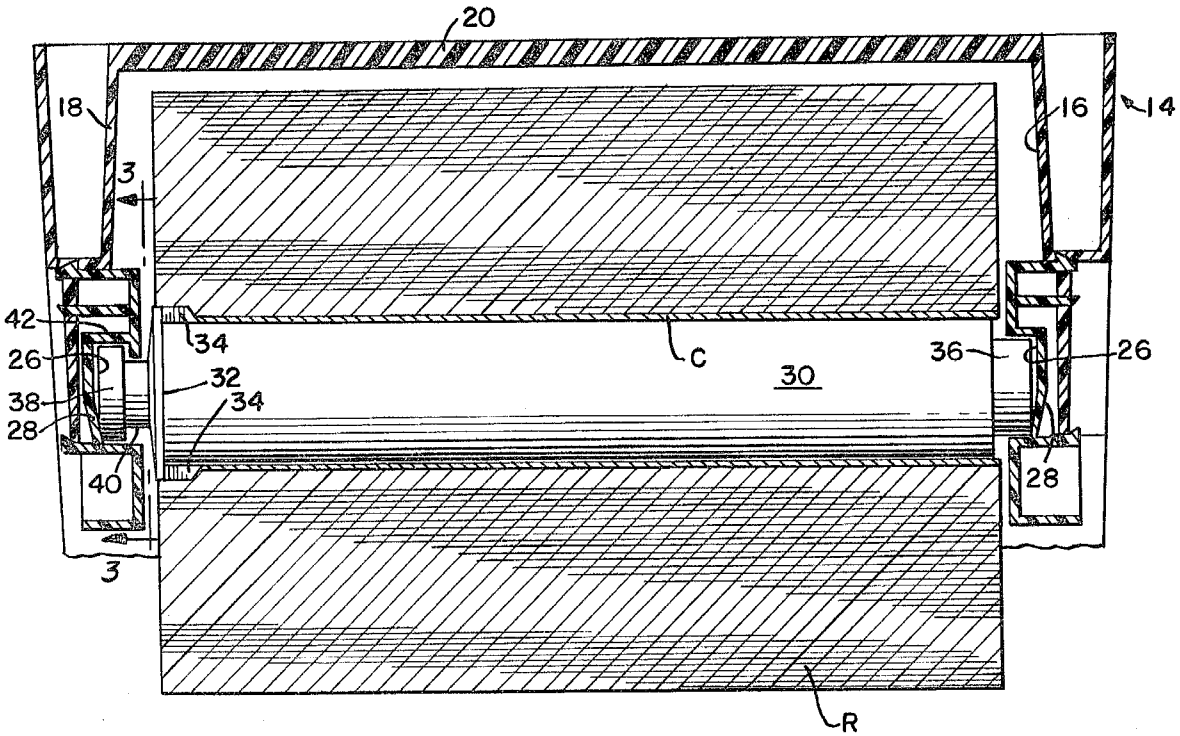
FIG. 2 is a sectional view taken on line 2—2 of FIG. 1.
Figure 4:
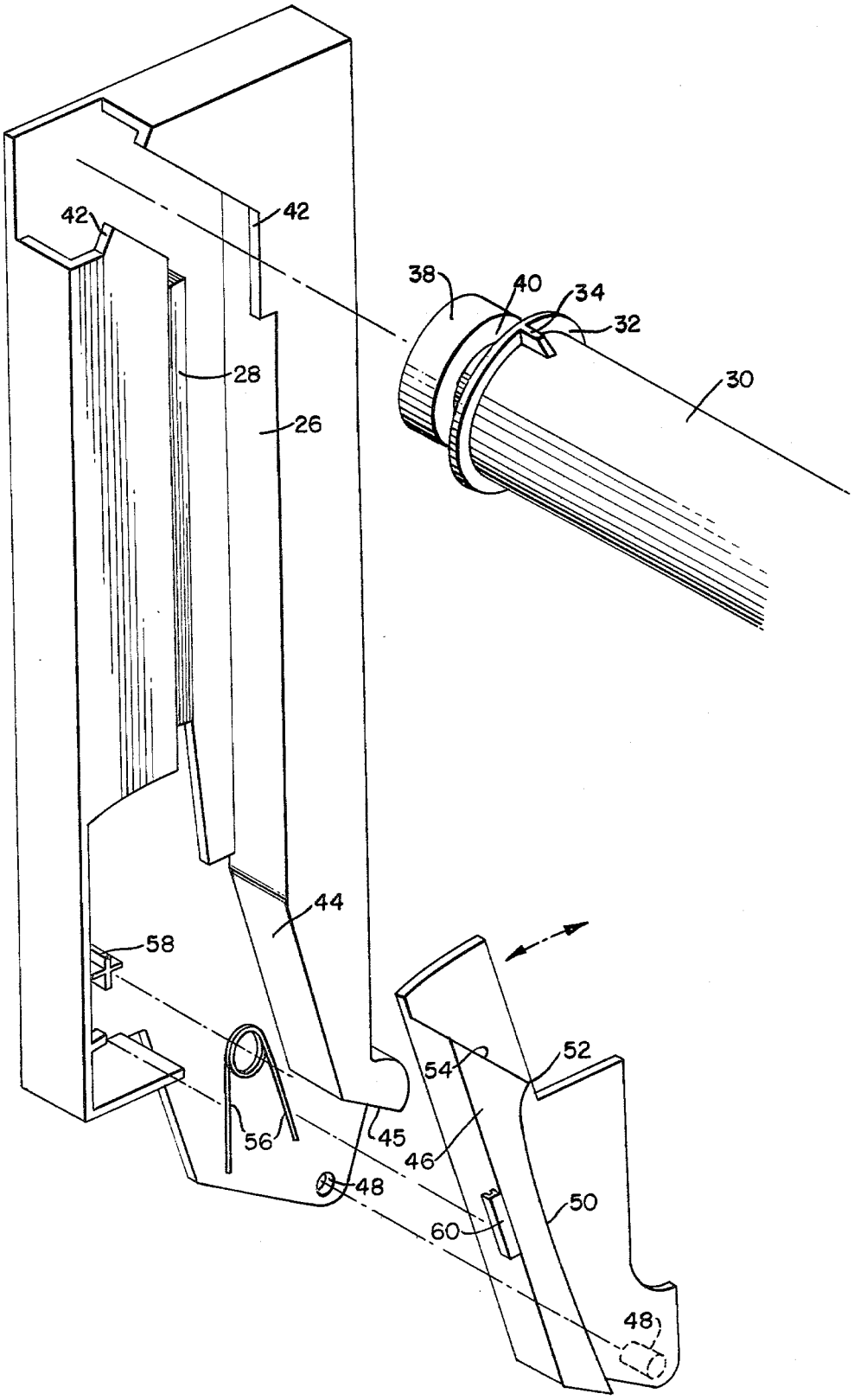
FIG. 4 is an exploded perspective view showing a roll mounting spindle relative to one of the inwardly facing tracks which are located on the opposite inner sidewalls of the dispenser housing.

In the embodiment shown, each of the opposite inner sidewalls 16 and 18 is provided with a vertical track 26, these being shown in section on FIG. 2 and one track, shown in perspective on FIG. 4, as carried by sidewall 18. Sidewall tracks 26 face inwardly to receive therein the spindles projecting outwardly from the core C of wound roll R of flexible sheet material.

A forward portion 28 of the backwall of each track 26 is inclined inwardly toward the interior of the dispenser housing 10. These inwardly inclined portions 28 of the tracks 26 engage the ends of the spindles extending outwardly from the ends of the core C of roll R adjacent the forward periphery of each spindle end as seen in FIG. 2. Thus, as a roll R moves down within tracks 26, engagement of the forward end portions of the spindles by inclined portions 28 tends to rotate the roll R in the direction that the sheet material will eventually be unwound from the roll. However, in a cabinet where multiple rolls are positioned within the tracks the presence of the lower most roll while being dispensed from the dispenser with the reserve roll resting thereon will prevent the rotation of an upper reserve roll from unwinding its sheet material prior to the lower most roll being substantially exhausted and moving into discard pocket P for spent roll cores. Then the reserve roll moves down into position to have the free leading end of its web of sheet material fed outwardly from the dispenser to the user.

Figure 3:
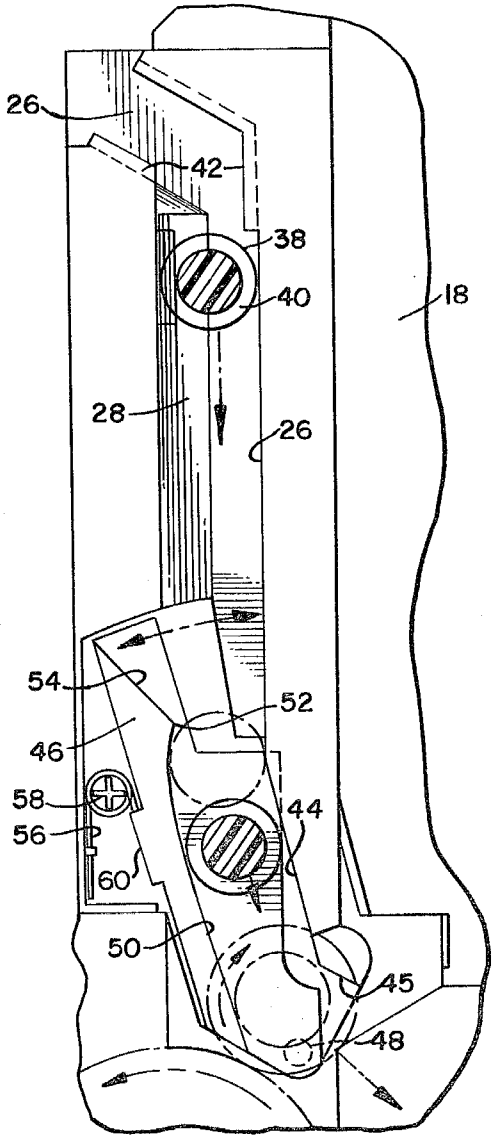
FIG. 3 is a view, partly in section, taken on line 3—3 of FIG. 2.

In the embodiment illustrated, as best shown in FIGS. 2, 3 and 4, the core C of roll R carries a mandrel 30 frictionally held within the core C. Mandrel 30 has a flange 32 at one end thereof and fins 34 extending outwardly from the cylindrical surface of mandrel 30. These fins 34 mate with slots formed extending outwardly through the roll core C into the wound sheet material to key the mandrel 30 and roll R positively together. A large cylindrical spindle 36 is provided extending outwardly from core C on mandrel 30 at one end of the mandrel while the opposite end of the mandrel has a spindle 38. Spindle 38 is formed with a peripheral groove 40 inwardly of its outermost end. One channel 26 has flanges 42 extending along both inner edges thereof at the upper end of this channel. Flanges 42 overlie a portion of this track 26 with the flanges extending into the groove 40 of spindle 38 when the roll R is being loaded into the dispenser. The advantage of having groove 40 to permit spindle 38 to enter the channel passing through the having flanges 42 is that proper loading of the roll within the dispenser is assured so that only one mandrel end, namely, the proper end of the roll, pass downwardly into this track 26. Spindle 36 without a groove 40, at the opposite end of the roll would not be able to enter the track 26 having flanges 42 and thus the roll must be inserted in loading the dispenser with spindle 38 only in the track 26 carried by wall 16. The keying by means of fins 34 in the slots formed in core C and roll R is important in operation of the dispenser so that the track driving action to rotate the roll is positively transmitted to the roll for dispensing in the manner as will be described.

The lower end section of each track 26 slants away from the longitudinal axis of the main length of the track as shown in FIGS. 3 and 4. These lower end sections of the two tracks are slanted rearwardly within the dispenser housing 10 and slant away from the axis of the feed roller described below such that the slanting section of each track lies on a line that is generally tangent to the periphery of the feed roller.

Each slanting section of a track 26 is formed by a stationary upper wall 44 and a pivotally mounted driving guide 46 pivotally mounted at 48 to the lower end of the track. Each driving guide 46 provides a friction surface 50 forming the lower track wall of the slanting section guide 46, as a whole, slanting away from the main track length. The upper end of friction surface 50 on each guide 46 has a projection 52 with an inclined cam area 54 extending thereabove. Each guide 46 is biased inwardly toward the center of the track 26 by a spring 56 mounted on a suitable stationary stud 58. One end of spring 56 presses against a stationary wall of the part forming track 26 while the other end of spring 56 engages in and presses against the outer wall of guide 46 and is held in a retainer 60 on guide 46. The bottom end wall 45 below stationary wall 44 is inclined rearwardly at a stepper angle. This wall 45 allows the spindle to pass between the feed roller and wall 45 into discard pocket P at the rear of the dispenser housing once the roll is substantially exhausted of sheet material, as will be described in more detail hereinafter.

The driving guide 46 is normally biased by spring 56 to pivot about pivot point 48 such that the guide is moved inwardly toward the center of the track 26. In this position, the inclined cam area 54 is disposed such that as the spindle moves down within the track 26 it will engage this cam area, camming the driving guide 46 forwardly and allowing the spindle to move over projection 52 and into the space between friction surface 50 and stationary upper wall 44. In this position the spindle rides against the friction surface 50 so that it is encouraged to rotate in a direction to unwind the sheet material from the roll. To promote this rotation of the roll under the action of the perimeter of a spindle riding down along friction surface 50, the surface may be provided with a coating providing a higher co-efficient of friction to more positively drive a roll spindle and roll carried thereby. Alternatively, a material having a high co-efficient to friction may be used in making the driving guide 46 to provide a higher co-efficient of friction for the surface 50.

The pivotally mounted driving guide 46 associated with each track 26 is preferably and advantageously pivoted on the side of the track which is in the direction toward which the web of sheet material will be drawn off of the roll incident dispensing rotation of the feed roller mounted adjacent the lower ends of tracks 26. Where the lower sections of the tracks are slanted, as illustrated and described in the preferred embodiment, the inclined friction surface 50, forming the lower side of the slanted track section, in and of itself, promotes the perimeter of the spindles to press firmly against this surface 50 and rotate. The pressure of the spindles against the stationary slanted wall 44, which is the upper wall of the slanted track section is lessened in such construction.

The force of pulling the web of sheet material off of a roll in the dispensing operation adds a further force drawing the spindles which carry the roll firmly against the inclined surface 50. Thus this force further also drives the roll and its spindles in moving down the inclined slanted friction surface 50 to promote rotation of the roll. Again, withdrawal of sheet material from the roll incident dispensing, while pressing the spindles more firmly against the surface of driving guides 46, lightens or even frees engagement of the spindle perimeter from the stationary wall 44.

Even where the track is straight throughout its length, without a slanted lower section, the action of a spring biased driving guide pivotally mounted in the track lower section adjacent the upper end of the feed roller is advantageous. By reason of its locating such guide on the side of the track 26 which is in the direction in which the web of sheet material is to be withdrawn from the roll the web withdrawing force passes the spindle against the pivotally mounted biased driving guide at the lower section of the track. This lessens or releaves the force against the opposite wall of the track which is stationary. Again, the urging toward rotation of the spindles and the roll carried thereby in the direction in which the web is to be unwound from the roll during dispensing contributes to effective and easy dispensing of sheet material from the roll.

A feed roller 62 is rotatably mounted within the dispenser housing 10 adjacent the lower end thereof for a roll to engage and be driven by the feed roller in dispensing sheet material from the roll. As shown, roller 62 is mounted generally beneath the main length of tracks 26 and is made up of several axially spaced cylindrical sections including a center section 64 and two end sections 66, the latter having their outer ends closed by end caps 67. Each of the feed roller sections has a cavity therein to provide an interior space within and along the length of the feed roll 62 which accommodates a serrated cutting knife 68. Feed roller sections 64 and 66 are slotted to provide an elongated external opening 70 on the periphery of the feed roller 62. Shaft ends 72 project from the opposite end caps 67 of feed roller 62 to rotatably support the feed roller by each shaft end 72 engaging in a bore 74 provided in a stationarily mounted cam block 76. It is to be understood that a cam block 76 is stationarily mounted at each end of the feed roller 62, these cam blocks being affixed to and facing inwardly from the opposite inner sidewalls 16 and 18 of chassis 14 which forms a part of the dispenser housing 10.

The cam block 76 provides a plate cam therein consisting of a cam pocket 78, opening, in the case of each cam block 76, toward the end of feed roller 62 with which it is associated. This pocket 78 has a parti-cylindrical portion with its center of curvature corresponding with the axis of bore 74 that receives shaft end 72 and also has an outwardly curved portion extending away from the axis of the feed roller 62. This latter portion is joined at its ends with the ends of the parti-cylindrical portion to form pocket 78 into an endless cam configuration.

The serrated cutting knife 68 is carried on a member 79 located within the interior space in feed roller 62, such member having cylindrical studs 80, one at each end of knife 68 and member 79, providing a pivot axis which is displaced from the plane of the cutting knife 68. The stubs 80 are engaged in apertures provided in the opposite end caps 67 of the feed roller 62. The knife also has at each end thereof, disposed in the plane of the cutting knife 68 a cam followe 82, one such cam follower extending through an opening in each end cap 67 of the feed roffler 62. The cam follower at each end of roller 62 fits into the pocket 78 of a stationary cam block 76 and thus is propelled to control extension and retraction of the cutting knife 68 out of and back into the feed roller 62 as the roller rotates in dispensing sheet material from a wound roll. Incident this rotation of roller 62, knife 68 projects outwardly, piercing the web of sheet material and severing it for removal of a length of the material from the dispenser through opening 24.

A fuller understanding and more detailed description of the action of the stationary cam blocks 76 in controlling, through cam followers 82, the projection and retraction of knife 68 may be found in Raymond F. DeLuca's application Ser. No. 248,533, filed Oct. 14, 1977. However, it should be mentioned here that, as will be made clear, the disposition of the cam pocket 78 in the stationary cam block 76 at each end of feed roller 64 is, in the instant invention, disposed to obtain a preferred action relative to other components of the structure which will be described hereinafter.

Also, it will be noted that the center section 64 of feed roller 62 is spaced at each of its ends from the inner ends of the two end sections 66 of such roller. These spaces, as shown more clearly on FIGS. 1 and 8, are provided for a purpose which will be made clear hereinafter.

Figure 8:
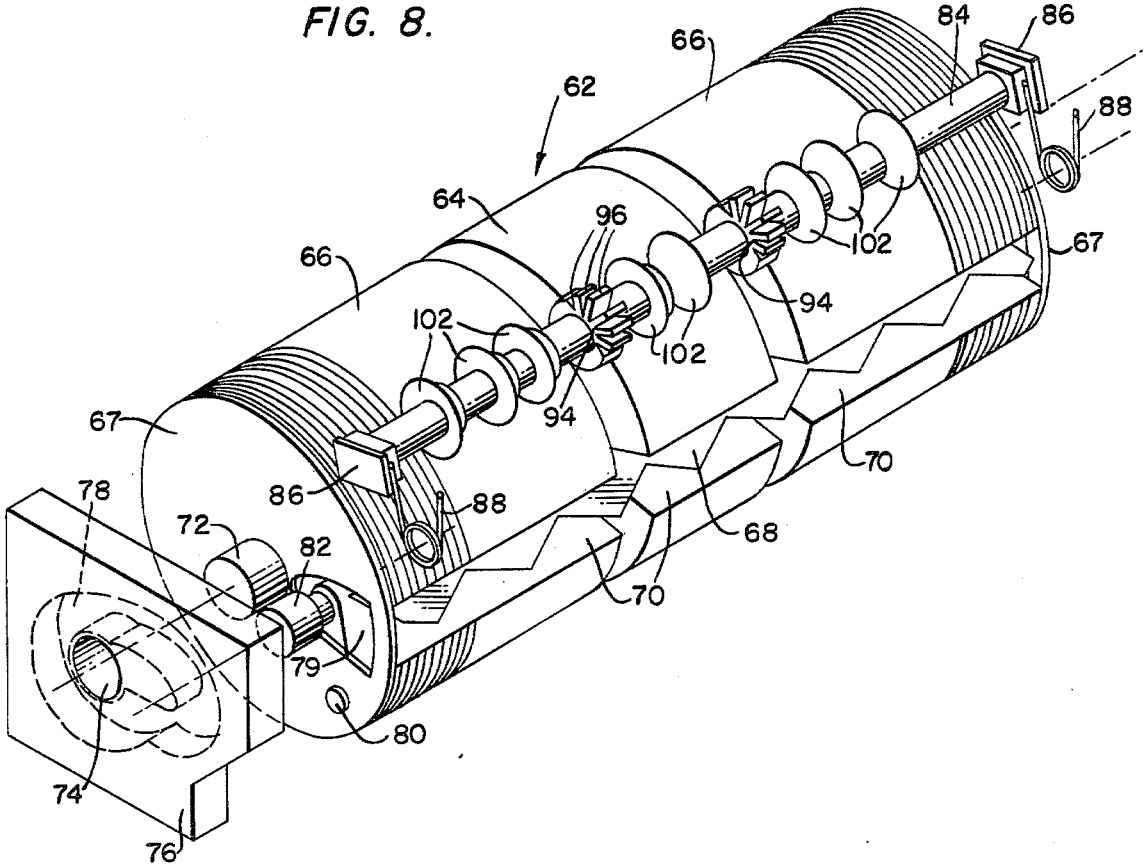
FIG. 8 is a perspective view showing the feed roller, pressure roller, material cutting knife and one stationary cam for arcuating the knife from within the feed roller.
Figure 9:
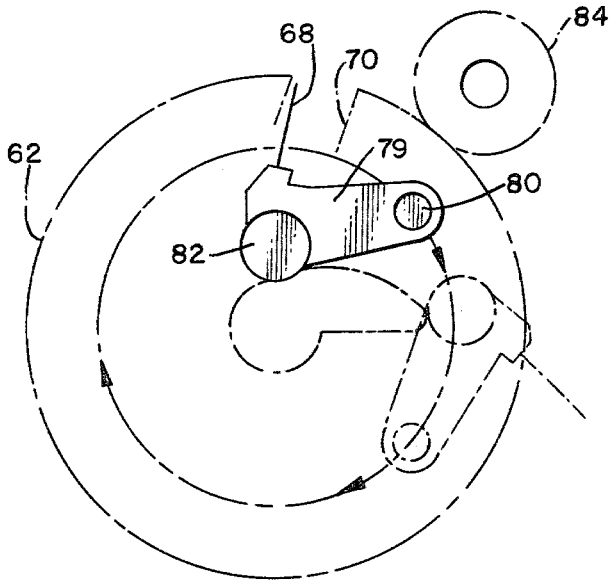
FIG. 9 is an end view, with portions shown in phantom, illustrating the action of camming the material cutting knife from within the feed roller shown in FIG. 8.

Concerning the cylindrical sections 64 and 66, making up the feed roller 62, these sections may all have the peripheral surfaces thereof provided with a high friction surfacing material up to the outer ringed ends and end plates 67 of the end sections 66, as shown in FIGS. 1 and 8. For good driving characteristics in moving the wound roll within the dispenser and feeding the sheet material off of the roll to the dispenser outlet opening 24, the center section 64 may have a rubber surface. The exterior cylindrical surfaces of all feed roller sections may be made of rubber for good feeding characteristics of the sheet material.

In the instant invention, the cam pockets 78 in the stationary cam blocks 76, one at each end of the feed roller 62, preferably have their configuration disposed such that the action on cam followers 82 which drive the knife out and retract it back within the roller 62 function to project the knife 68 in the pattern of movements shown on FIG. 7. Thus, in the instant invention, the knife 68 as it is initially cammed out through the opening 70 commences at a point immediately before the nip of feed roller 62 formed in conjunction with a pressure roller 84. As rotation of feed roller 62 proceeds relative to the stationary cam pockets 78 in cam blocks 76, the serrated knife edge projects further and further out of the interior space within roller 62 to progress through the several projected stages as shown in phantom lines on FIG. 7. While the knife is quickly projected out through the opening 70 of roller 62 of effectively sever the web W of sheet material the knife is also rapidly withdrawn or retracted back into the roller 62 as it moves through the positions under the control of the configuration of cam pockets 78 within which the cam followers 82 follow.

The construction of the pressure roller 84 may best be seen in the perspective view of FIG. 8. Roller 84 is rotatably mounted in bearing blocks 86, one such bearing block receiving an end of roller 84 at each of the rollers ends. Each bearing block 86 is slideably mounted in a slot (not shown) provided in the sidewalls 16 and 18 of the chassis 14 forming a part of the dispenser housing 10. The slots in the sidewalls 16 and 18 are oriented generally radially relative to the rotation axis of feed roller 62, such that the pressure roller 84 may move toward and away from the axis of roller 62 provided by the ends of shaft 72 mounting such feed roller. The pressure roller 84 is spring biased toward the cylindrical surface of feed roller 62 by the bearing blocks 86 at each end of roller 84 being engaged by springs 88, one at each of the pressure roller 84, as shown in FIG. 8. One end of each spring 88 presses against a bearing block 86 to urge it and pressure roller 84 carried thereby toward the surface of feed roller 62. The opposite end of each spring 88 engages a stationary abutment 90, one carried by each of walls 16 and 18 while the mid-portion of each spring 88 is suitably supported on a stud 92, also carried by each wall 16 and 18 (see FIGS. 5 and 6).

Secured to pressure roller 84 are a pair of spaced resiliently deformable segments 94. Each segment is eccentric and resiliently deformable relative to the roller 84 axis. In the embodiment illustrated in FIGS. 8 and 13, the resilient segment is formed by a plurality of radiating resilient fingers 96. It will be seen that these elements, rotating with pressure roller 84, move with such roller so that the outwardly projecting resilent segments 94, which are eccentric with the axis of roller 84, may pass within the spaces provided between each end of section 64 and end sections 66 of the feed roller 62.

Whereas in FIGS. 7, 8 and 10–13 the resiliently deformable segments 94 have been shown formed by the radiating resilient fingers 96. Another embodiment which may be employed is shown in FIG. 14. In this embodiment the resiliently deformable segment is formed by an outwardly projecting arcuate wall 98 which is bowed outwardly from the portion of the element secured to pressure roller 84 to form the eccentric resilient deformable segment. This arcuate wall 98 provides a surface to engage and pick up the leading free end of sheet material upon the exterior of an outer roll surface in the same manner as the resilient generally radiating fingers 98 function for the embodiment shown in FIG. 13. This will be described in more detail with reference to the action shown being carried out in FIGS. 10, 11 and 12. As further shown on FIG. 14, the outwardly projecting arcuate wall 98 may be reinforced by providing radial webs 100 extending outwardly from the axis of pressure roller 84 to the underside of arcuate wall 98.

Figure 13:
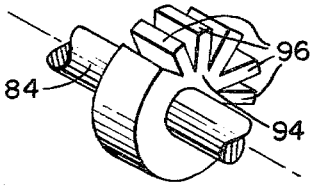
FIG. 13 is a perspective view showing a resiliently deformable segment which is eccentric to the pressure roll axis to pick up the leading edge of sheet material on a full roll.
Figure 14:
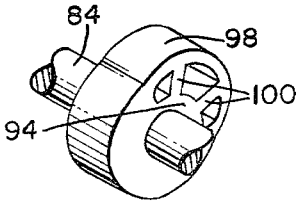
FIG. 14 is a perspective view of an alternative embodiment for a resiliently deformable eccentric segment to that shown in FIG. 13.

It will be understood that the embodiments shown in FIG. 13 and 14 may be appropriately made of any rubber like material which not only will give the desired frictional characteristics for the function of the eccentric segments in picking up the leading free end of sheet material from the exterior of a roll, but also this will give the desired resiliency and deformability for effective action in use of the dispenser in feeding sheet material from a wound roll.

The pressure roller 84 also has axially spaced therealong, resilient conical portions 102. Each conical portion 102 on roller 84 provides a cylindrical perimeter which presses against the feed roller 62 surface to define a nip between these two rollers. As seen from FIG. 8, the two center conical portions 102 ride against the center section 64 of the feed roller while the conical sections outwardly of the eccentric segments 94 ride on the end sections 66 of feed roller 62. An important feature of the location and positioning of the conical portions 102 rotating with pressure roller 84 is that each conical portion faces inwardly toward the mid-point of pressure roller 84. This performs a particular function in acting to spread out the sheet material along the length of the nip between feed roller 62 and pressure roller 84. Under the action of springs 88 at each end of pressure roller 84 the conical portions 102 tend to be deflected at the nip between the rollers so that the cylindrical perimeter is bent somewhat laterally away from the mid-point of roller 84. By reason of the conical portions facing inwardly toward the mid-point of pressure roller 84 this deflection of the cylindrical perimeters of the portions 102 moves the perimeters axially outwardly which acts on the sheet material passing between the nip of the rollers to spread it outwardly toward the ends of pressure roller 84 thus encouraging the sheet material to pass between feed roller 62 and pressure roller 84 in a fully spread out, taught condition.

Before considering other structures employed in effectively leading the sheet material leaving the feed roller out of the dispenser housing to be accessable to a user, discussion may be provided concerning the function of the eccentric segments 94 forming a part of pressure roller 84 as best shown on FIGS. 7, 10, 11 and 12.

Referring to FIG. 7, a substantially exhausted initial roll ER is shown within a discard pocket P at the rear portion of the chassis 14 in front of rear wall 20 and above bottom wall 22. This roll ER would have been the lowermost roll loaded into the dispenser with a reserve roll still located above the lowermost roll and resting on the lowermost roll surface in readiness to move into position once the lowermost roll has become substantially exhausted. Thus, roll ER, with a limited amount of sheet material still wound thereon, has moved down through the tracks 26 and, after becoming substantially exhausted, its spindles have moved beneath the inclined walls 45 at the lower ends of tracks 26 and over the surface of feed roller 62 to drop into the discard pocket P. The web of sheet material is still being fed over the top of feed roller 62 and between the nip of feed roller 62 and pressure roller 84 with the web W exiting through the dispenser housing opening 24.

It will of course be understood that while the feed roller 62 continues its rotation under the action of withdrawing web W from the opening 24 of the dispenser housing 10, the camming action under the driving force of stationary cam pockets 78 on cam followers 82 will project and retract the knife 68 in accordance with the movements illustrated on FIG. 7. The projecting action of knife 68 will serve to sever a length of web W for each rotation of feed roller 62 so that the cut off length of sheet material may be withdrawn from the dispenser cabinet by the intending user.

The structure of pressure roller 84, incorporating spaced eccentric segments 94 and conical portions 102, also is advantageous in cooperating with the serrations of cutting knife 68. These knife serrations are spaced to accommodate therebetween not only the eccentric segments 94 but also the conical resilient portions 102. This may be seen from the phantom shown position of pressure roller 84 in FIG. 1. By this relationship between the cutting knife serrations and the eccentric segments 94 and conical portions 102, it is possible to initiate camming of the knife through the opening 70 in feed roller 62 commencing at a point immediately before the nip of the feed and pressure rollers. This is of course advantageous in that when the web of sheet material is located between the two rollers, the conical portions 102 are acting to spread the sheet material along the length of the pair of rollers and the nip between the rollers holds the sheet material firmly in this spread condition. As shown in FIG. 7, the projection of the knife through the opening 70 immediately before the nip of the rollers permits the outermost ends of the knife serrations to pass into the web of sheet material and initially perforate it along the length of the pair of rollers. At this time the rollers act to firmly hold the web of sheet material against displacement. As the sheet material passes on through the nip, the cam action on cam followers 82 continues to move the knife 68 outwardly. When it passes the nip between rollers 62 and 84 it is rapidly projected to complete severing of the web of sheet material for removal from the dispensing cabinet. As previously mentioned, the knife, under the control of the stationary cam pockets 78, is then rapidly retracted back into the feed roller 62 in readiness, on the next revolution of such roller, to perform a subsequent web cutting action.

At this point, shown in FIG. 7, the roll that was disposed upwardly in the track as a reserve roll has moved down until in its full position its spindles are engaging with the friction surfaces 50 of the driving guides 46 on the opposite sidewalls 16 and 18 of the chassis 14. The diameter of this reserve roll, which now is readiness for removal of sheet material therefrom and is thus in the dispensing position, is such that it not only rests and drivingly engages with the surface of feed roller 62 but it also is of a sufficient diameter that it will be engaged by the eccentric segments 94 on the pressure roller 84 as such roller rotates along with the feed roller 62. As the remaining sheet material continues to be withdrawn from the substantially exhausted roll ER in the discard pocket P, it continues to rotate the rollers in passing through the nip therebetween, the withdrawing action occuring either under the pull of a perspective user externally of the dispenser or manually operated by the manual hand wheel 104 as will be described subsequently.

The rotation of pressure roller 84 will carry the resiliently deformable segments 94 around to bring them into frictional contact with the exterior of the fresh full roll in dispensing position which was formally disposed upwardly in the dispenser cabinet as a reserve roll. The surface engagement of this new full roll in the dispensing position with the feed roller 62 and with rotation encouraged by its spindles frictionally engaging with the surfaces 50 on the driving guides 46 within the lower section of the tracks 26 causes rotation in a direction to feed the loose free end of the sheet material onto the resilient segments 94 of the pressure roller 84.

Figure 10:
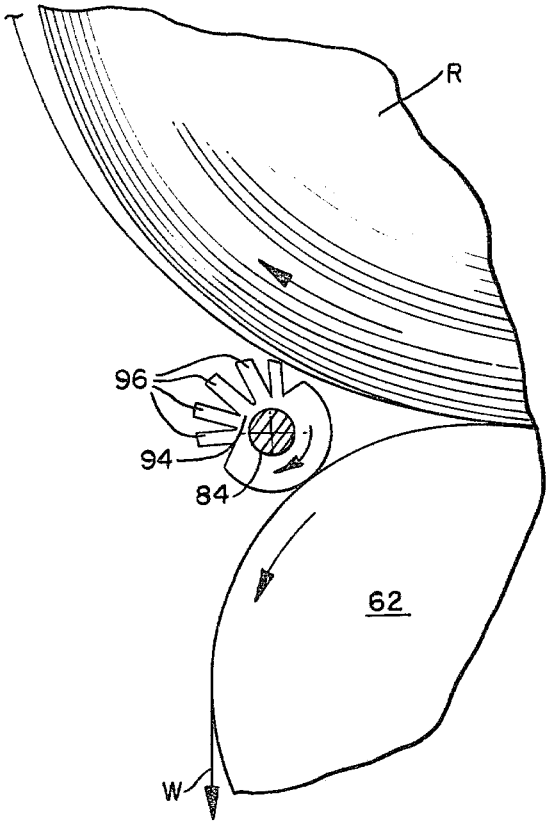
FIG. 10 is a partial end view showing the relationship of the feed roller and pressure roller to a full wound roll of material as the pressure roller approaches picking up the leading free web end of a full roll.
Figure 11:
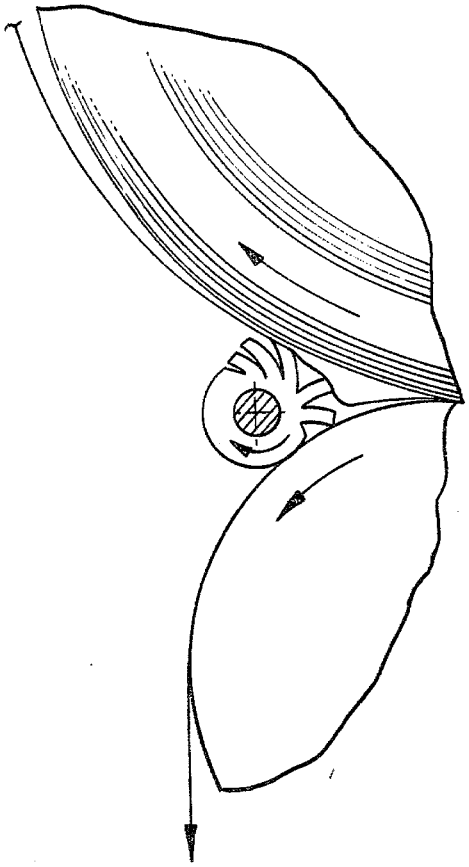
FIG. 11 is a view similar to FIG. 10 but showing the pressure roller buckling the free end of the web material on a full roll to be fed between the nip of the feed roller and the pressure roller.
Figure 12:
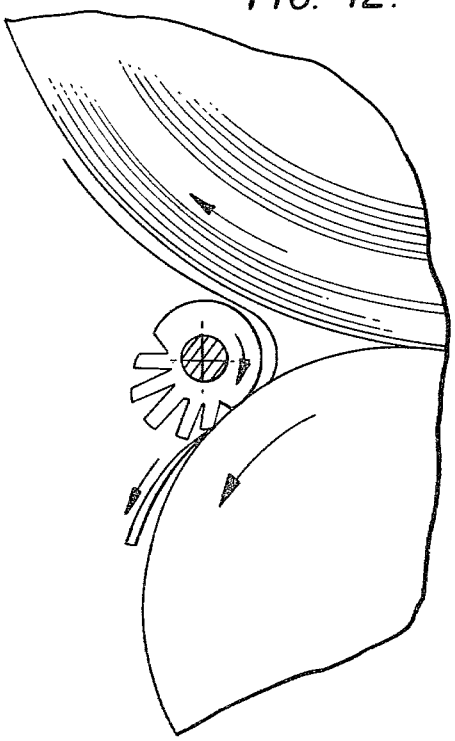
FIG. 12 is a view also similar to the showing in FIG. 10 showing the lead end of the full roll being fed downwardly between the nip of the feed and pressure rollers.

Referring to FIGS. 10, 11 and 12, the action of the eccentric segments 94 on the pressure roller 84 will follow the action shown. The feed roller 62 is rotating counter clockwise while pressure roller 84 is rotating clockwise with the web of sheet material passing between the nip of these two rollers. The clockwise rotation, as shown in FIGS. 10–12, has the effect as the eccentric segments 94 on the pressure roller 84 move into frictional engagement with the outer free layer of roll R of buckling this free end as rotation progresses between the three elements, as shown in FIG. 11. The web W at this point is still being withdrawn from the substantially exhausted roll ER in the discard pocket P so that withdrawal of the web by a user tends to assure continued rotation of the elements, as shown in FIGS. 10 and 11. The buckling action created by the eccentric segments 94, performing by use of resilient fingers 96 in the embodiment shown in FIGS. 10 and 11, carries the buckling action to a point where the buckled sheet material web is drawn positively and firmly into the nip between feed roller 62 and pressure roller 84. As this action proceeds, the outer free end on the new full roll is carried in double thickness between the rollers and fed out through opening 24 in the dispenser housing 10. If the first brush or frictional engagement of the eccentric segments 94 on pressure roller 84 do not effectively pick up the leading free end of the fresh new full roll R, the elements will continue their rotation and successive brushes or frictional engagements between the segments 94 and the outer layer of sheet material on roll R will be repeated as the remainder of sheet material is being withdrawn from the nearly exhausted roll ER in discard pocket P.

Once the leading free end of web sheet material on the new roll in dispensing position is picked up, several thicknesses of shet material may be fed from the dispenser for a period of time until the web sheet material on roll ER is fully exhausted. Also there may be a period where the double thickness coming from the buckled surface layer of sheet material off of full roll R as shown in FIG. 12 may be fed out of the dispenser along with the remaining material on roll ER. However, the action of eccentric segments 94 will effectively and positively pick up and feed sheet material into the nip between the feed roller and pressure roller from the new roll. Thus, this roll will be brought into operation for dispensing from the unit.

The dispenser functions in such a manner that, at the end of each cycle, the leading end of the sheet material extends outwardly of the dispenser cabinet, in order to be grasped by the user. The mechanism for dispensing sheet material has means for measuring the length of each segment of such material that is dispensed and stopping the dispensing action at the end of this desired length. Also, manual feeding is provided. The manual feeding mechanism and associated components are best shown on FIGS. 5 and 6.

The mechanism includes a manual feed wheel 104 mounted on the end of feed roller 62 as shown more clearly in section on FIG. 1. Thus, a screw 106 is threaded into the end of feed roller 62 to securely fasten the feed wheel 104 to rotate with such roller. The periphery of feed wheel 104 is provided with alternating recesses 108 and projections 110 to facilitate its rotation by the fingers of a user. Rotation of the feed wheel 104 causes the feed roller 62 to rotate and cam the knife 68 outwardly and inwardly as previously described. A link 112 is pivotally connected to a screw 114 threaded into the feed wheel 104 at a point radially offset and therefore eccentric to the axis of rotation of the wheel formed by securing screw 106. A spring 116 is secured to the opposite end of link 112 while the upper end of spring 116 is fastened at 118 to the sidewall 16 of the chassis 14.

Figure 6:
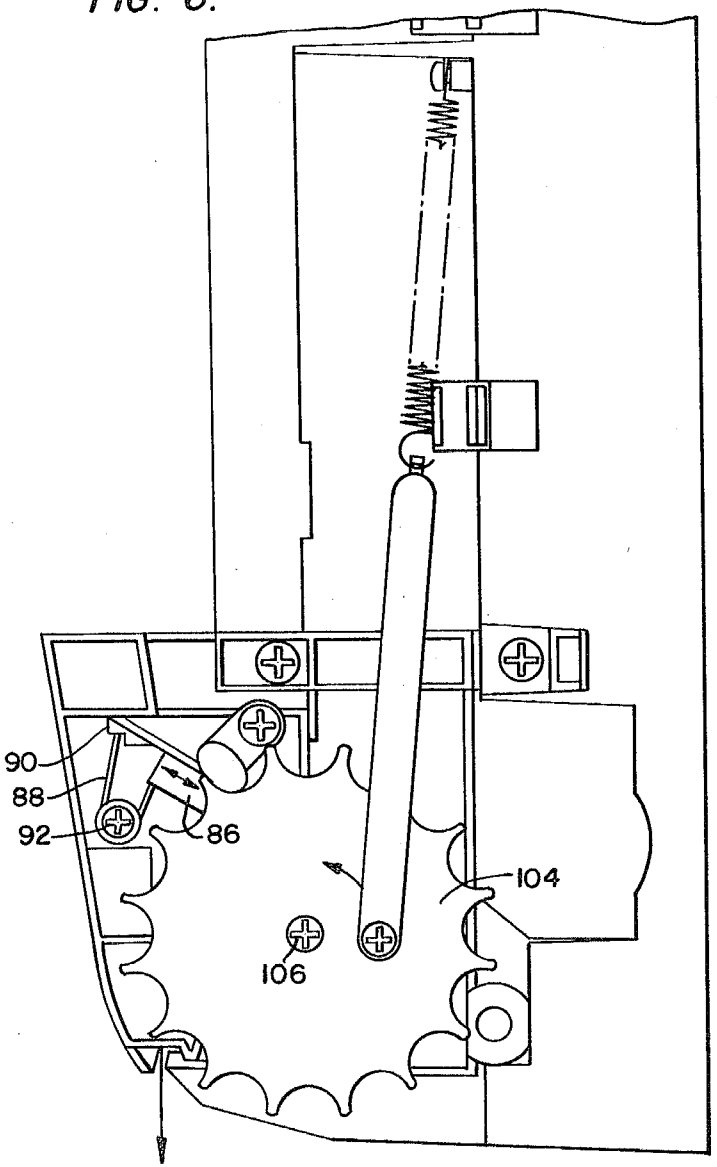
FIG. 6 is a view similar to FIG. 5 but showing the dispenser mechanism in a position where web material dispensing is in progress.
Figure 5:
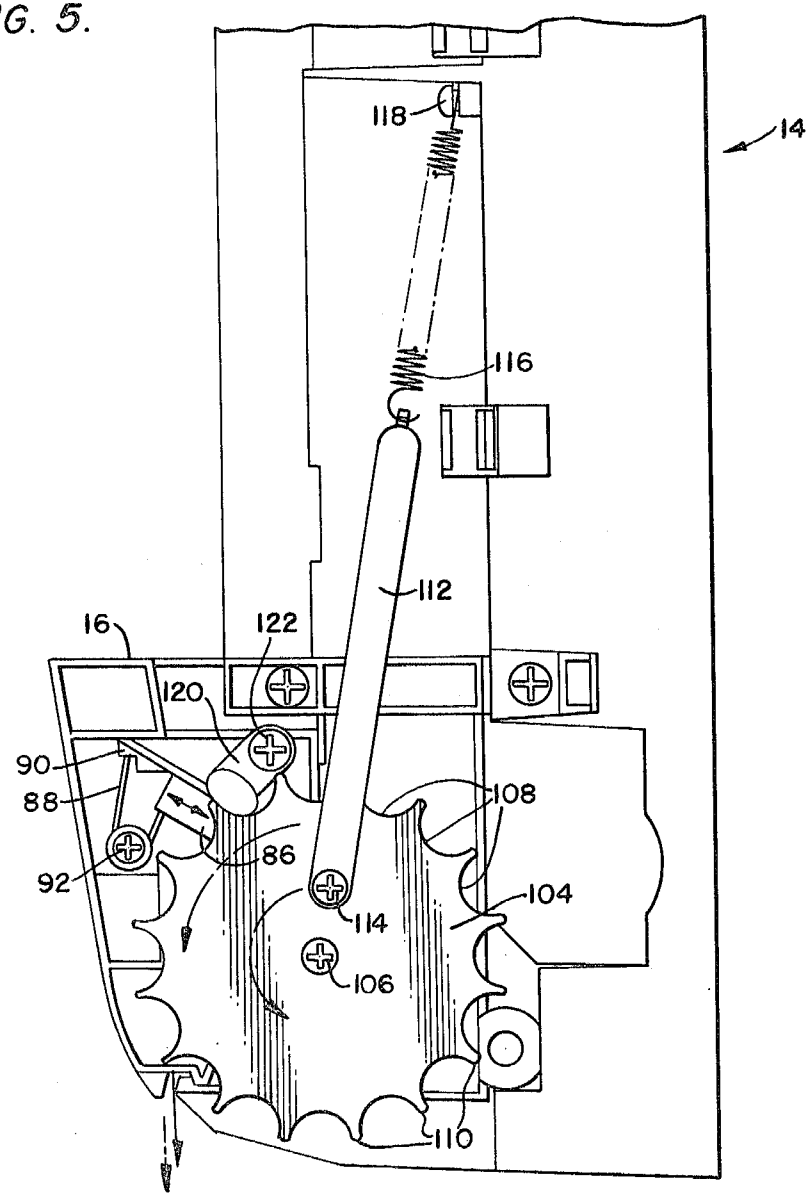
FIG. 5 is a view taken on line 5—5 of FIG. 1 with the cover sidewall of the dispenser housing removed to expose the mechanism for feeding flexible sheet material.

An anti-reverse pawl 120 is pivotally mounted on a screw 122 threaded into sidewall 16 of the chassis 14. This pawl rides in the recesses 108 of feed wheel 104 and prevents the feed wheel from rotating clockwise as shown in FIGS. 5 and 6.

The spring 116, acting through link 112, pivotally connected by screw 114 eccentrically of the rotation axis of feed wheel 104, provides a force assist to sever the sheet material so that the act of severing the material is accomplished without the need of a user increasing his pull upon the sheet material coming from the dispenser. During the first part of rotation of feed wheel 104, the spring 116 is tensioned as the wheel moves counter-clockwise as shown in FIGS. 5 and 6. After the screw 114 passes the lower most point, opposite its position shown in FIG. 5 or 180° from the position shown in FIG. 5, the spring 116 pulls upwardly, thus helping to rotate manual feed wheel 104 with roller 62 and cam cutter 68 outwardly and then inwardly to perform the sheet material severing operation.

The foregoing sets forth a detailed description of the dispenser for wound roll flexible sheet material of the invention, wherein multiple rolls of such material may be loaded into the dispenser and each roll in succession have its web of sheet material picked up and fed from the dispenser. It is to be recognized that various modifications of the dispenser of this invention may occur to those skilled in the art. Therefore, the scope of the invention is to be limited solely by the scope of the appended claims.

I claim:

1. A dispenser for wound rolls of flexible sheet material that have supporting spindles projecting outwardly from the roll core ends comprising:

a dispenser housing to receive the rolls to be dispensed having inwardly facing tracks on the opposite inner side walls of said housing for the rolls to move downwardly within said tracks with the lower end section of each track slanting away from the longitudinal axis of the main length of the track, roll driving guide means pivotally mounted adjacent the lower end of each said track with means biasing said guide means inwardly toward the center of the track, each said guide means providing a friction surface along each slanting track section to engage the periphery of the roll spindle within the track and promote roll rotation during said downward movement of the roll, a feed roller rotatably mounted within said dispenser housing adjacent the lowermost ends of said tracks so that the periphery of a roll having the spindle therefor engaged by said guide means will engage and be driven by rotation of said feed roller, and means for leading sheet material leaving said feed roller out of said dispenser housing to a user.

2. A dispenser as recited in claim 1 wherein said friction surface on each said guide means is constructed from material having a high coefficient of friction to induce roll rotation when moving down said tracks.

3. A dispenser as recited in claim 1 wherein each said guide means is provided by a driving guide pivotally connected adjacent the bottom end of each said track with said friction surface forming the lower side of the track section slanting away from the main track length.

4. A dispenser as recited in claim 3 wherein the upper end of each said guide has a projection and an inclined cam area above said projection such that the roll core spindle cams said guide out from its inwardly biased position within the track upon moving down in said tracks to engage said friction surface.

5. A dispenser as recited in claim 1 wherein one of said tracks is provided with inwardly extending flange means along the inner face of said one track spaced from the outer wall of said one track, said flange means being disposed adjacent the upper end of said one track whereby a roll core spindle having a peripheral groove inwardly of the spindle outer end can enter said one track with the groove passing said flange means to assure that the wound roll is inserted in said dispenser housing in the proper direction.

6. A dispenser as recited in claim 1 wherein each said slanting track section is inclined down and away from the rotation axis of said feed roller.

7. A dispenser as recited in claim 6 wherein the lower side of each said slanting track section lies on a line that is generally tangent to the periphery of said feed roller.

8. A dispenser as recited in claim 1 wherein a pressure roller is biased into rotating engagement with said feed roller for material from a roll to drivingly pass between the nip of said rollers.

9. A dispenser as recited in claim 8 wherein said pressure roller has provided thereon resiliently deformable means disposed eccentric to the axis of said pressure roller to pick up the leading free end of sheet material upon a full roll engaging said rollers to carry this free end into the nip between said rollers.

10. A dispenser as recited in either of claims 8 or 9 wherein said pressure roller carries axially spaced conical resilient portions along the length thereof with each of said conical portions facing inwardly toward the mid-point of said pressure roll.

11. A dispenser for wound rolls of flexible sheet material that have supporting spindles projecting outwardly from the roll core ends comprising:

a dispenser housing to receive the rolls to be dispensed having inwardly facing tracks on the opposite inner side walls of said housing for the rolls to move downwardly within said tracks, a roll driving guide means pivotally mounted adjacent the lower end of each said track with means biasing said guide means inwardly toward the center of the track, each said guide means providing a friction surface to engage the periphery of the roll spindle within the track and promote roll rotation during said downward movement of the roll, a feed roller rotatably mounted within said dispenser housing adjacent the lowermost ends of said tracks so that the pheriphery of a roll having the spindle thereof engaged by said guide means will engage and be driven by rotation of said feed roller, and means for leading sheet material leaving said feed roller out of said dispenser housing to a user.

12. A dispenser as recited in claim 11 in combination a roll is provided with a mandrel extending through the core of said roll with the ends of said mandrel forming spindles extending beyond said core to slideably engage in said inwardly facing tracks, said mandrel having fins extending outwardly from the perimeter of the mandrel portion fitting within said core at one end of said mandrel, one end of said roll being slotted outwardly from said core into the roll sheet material and said fins engaging in said slotted one roll end to key the mandrel and roll together against relative rotation therebetween.

13. A dispenser combination as recited in claim 12 wherein one end portion of said mandrel forming a spindle has a peripheral groove formed inwardly of the outer end of said one end portion, one of said tracks is provided with inwardly extending flange means along the inner face of said one track spaced from the outer wall of said one track, said flange means being disposed adjacent the upper end of said one track whereby said one end portion of said mandrel enters said one track with said peripheral groove passing said flange means to assure that the wound roll is inserted in said dispenser housing in the proper direction.

14. A dispenser for wound rolls of flexible sheet material comprising:

a dispenser housing to receive the rolls to be dispensed having means for supporting a roll therein in a position for sheet material dispensing, a feed roller rotatably mounted within said dispenser housing adjacent the lower end of said housing for the roll to engage and be driven by said feed roller in dispensing sheet material from the roll, a pressure roller biased into rotating engagement with said feed roller for the sheet material to pass between the nip of said rollers, said pressure roller having resiliently deformable means disposed eccentric to the axis of said pressure roller to pick up the leading free end of sheet material upon the outer roll surface engaging said rollers to carry this free end into said nip, and means for leading sheet material leaving said rollers out of said dispenser housing to a user.

15. A dispenser as recited in claim 14 wherein said resiliently deformable means comprises at least one resiliently deformable segment secured to rotate with said pressure roller, said segment being resilient and projecting outwardly throughout a peripheral part of the pressure roller circumference.

16. A dispenser as recited in claim 15 wherein said segment is formed by generally radiating resilient fingers projecting generally radially outwardly of the axis of said pressure roller.

17. A dispenser as recited in claim 15 wherein said segment is formed by an outwardly projecting arcuate resilient wall which is eccentric to the axis of said pressure roller and provides a curved wall surface to engage and pick up the leading free end of sheet material upon the outer roll surface.

18. A dispenser as recited in claims 15, 16 or 17 wherein said pressure roller carries axially spaced resilient portions along the length thereof with each providing a cylindrical perimeter pressing against the feed roller surface to define the nip between said rollers.

19. A dispenser as recited in claim 18 wherein said axially spaced resilient portions on said pressure roller are conical in configuration with each conical portion facing inwardly toward the mid-point of said pressure roller to promote spreading out the sheet material passing through the nip of said rollers.

20. A dispenser as recited in claim 18 wherein said feed roller includes axially spaced cylindrical sections which engage with said pressure roller, at least two of said sections being spaced to accommodate passage therebetween of said resiliently deformable segment on said pressure roll incident rotation of said pressure roller.

21. A dispenser as recited in claim 18 wherein said feed roller has a serrated cutting knife pivotally mounted therewithin, said feed roller has an elongated external opening for projection of said knife therethrough, stationary cam means is mounted relative to said feed roller to cam said knife out through said opening incident rotation of said rollers to sever the sheet material, and the serrations on said knife are spaced to accommodate therebetween said resiliently deformable segment on said pressure roller.

22. A dispenser as recited in claim 14 wherein said resiliently deformable means comprises resiliently deformable eccentric segments spaced along said pressure roller, axially spaced conical resilient portions are spaced along the length of said pressure roller disposed on opposite sides of said eccentric segments, each said conical portion facing inwardly toward the mid-point of said pressure roller, said feed roller has a serrated cutting knife pivotally mounted therewithin with an elongated external opening in said feed roller for projection of said knife therethrough, and stationary cam means is mounted relative to said feed roller to cam said knife out through said opening incident rotation of said rollers to sever the sheet material.

23. A dispenser as recited in claim 22 wherein said stationary cam means is operatively positioned relative to said pivotally mounted knife to initiate camming of said knife out through said opening immediately before the nip of said rollers, and the serrations on said knife are spaced to accommodate therebetween said eccentric segments and said conical resilient portions.

24. A dispenser for wound rolls of flexible sheet material that have supporting spindles projecting outwardly from the roll core ends comprising:

a dispenser housing to receive the rolls to be dispensed having inwardly facing tracks on the opposite inner sidewalls of said housing for the rolls to move downwardly within said tracks, movably mounted roll driving guide means positioned adjacent the lower end of each said track with means biasing said guide means inwardly toward the center of the track, each said guide means providing a friction surface to engage the periphery of the roll spindle within the track and promote roll rotation during said downward movement of the roll, a feed roller rotatably mounted within said dispenser housing adjacent the lowermost ends of said tracks so that the periphery of a roll having the spindle therefor engaged by said guide means will engage and be driven by rotation of said feed roller, and means for leading sheet material leaving said feed roller out of said dispenser housing to a user.

25. A dispenser for wound rolls of flexible sheet material comprising:

a housing, means mounted within said housing for rotatably supporting a roll therein, a feed roller rotatably mounted within said housing adjacent said supporting means and arranged so that the periphery of a roll held by said supporting means will engage and be driven by said feed roller, and a pressure roller rotatably mounted within said housing and engaging said feed roller, said feed and pressure rollers defining a nip therebetween through which the sheet material passes, said pressure roller including means for picking up the leading free end of the sheet material on the outer surface of a full roll engaging said feed and pressure rollers to carry said free end into said nip.

26. A dispenser for wound rolls of flexible sheet material comprising:

a housing, means mounted within said housing for rotatably supporting a roll therein, a feed roller rotatably mounted within said housing adjacent said supporting means and arranged so that the periphery of a roll held by said supporting means will engage and be driven by said feed roller, and a pressure roller rotatably mounted within said housing and engaging said feed roller, said feed and pressure rollers defining a nip therebetween through which sheet material passes, said pressure roller including means for urging the sheet material axially outwardly of said feed roller to spread the material along the surface of said feed roller as the material passes through said nip.

27. A dispenser as recited in claim 26 wherein said urging means comprises a plurality of resilient, spaced, substantially conical portions positioned along the length of said pressure roller with the apex end of each of said portions oriented toward the axially central, transverse mid-plane of said pressure roller and the periphery of each of said portions engaging the periphery of said feed roller.

28. A dispenser as recited in claim 26 wherein said pressure roller further includes means for picking up the leading free end of the sheet material on a full roll engaging said feed and pressure rollers to carry said free end into said nip.

29. An article of manufacture comprising:

a roll of flexible sheet material having an internal passageway therethrough, a slot extending from said passageway into the roll at one end of the roll, and roll mounting means disposed in said passageway and having a rib extending into said slot to rotatably lock said roll and said mounting means together, said mounting means further having portions extending axially outwardly beyond the ends of the roll and adapted to be rotatably mounted in a dispenser, one of said portions having a smaller minimum transverse cross-sectional dimension than the other of said portions, whereby said one portion is adapted to be received in a similarly dimensioned dispenser supporting structure and said other portion is too large to be received in said supporting structure so that said portions can be mounted in the dispenser with the roll axially oriented in one direction only.

30. An article of manufacture as recited in claim 29 wherein said one portion comprises an axially inner section having said smaller minimum transverse cross-sectional dimension and an axially outer section contiguous to said inner section and having a minimum transverse cross-sectional dimension larger than said smaller dimension.

31. An article of manufacture as recited in claim 30 wherein said inner and outer sections have circular transverse cross-sections.

32. An article of manufacture as recited in claim 29 wherein said mounting means comprises a one-piece spindle extending through said passage-way.

* * * * *